US005993160A

United States Patent [19]

Bouchard et al.

[11] Patent Number: 5,993,160

[45] Date of Patent: Nov. 30, 1999

[54] COVER PLATE FOR GAS TURBINE ROTOR

[75] Inventors: Guy Bouchard, Mont St. Hilaire; Hugues Rhonald Brunet, St. Bruno de Montarville, both of Canada

[73] Assignee: Pratt & Whitney Canada Inc., Longueuil, Canada

[21] Appl. No.: 08/988,962

[22] Filed: Dec. 11, 1997

[51] Int. Cl.[6] ..... F01D 5/32

[52] U.S. Cl. ..... 416/193 A; 416/220 R

[58] Field of Search ..... 416/193 A, 219 R, 416/220 R, 248; 403/335, 337

[56] References Cited

U.S. PATENT DOCUMENTS

| | | | |
|---|---|---|---|
| 2,753,149 | 7/1956 | Kurti . | |
| 3,112,914 | 12/1963 | Wellman | 416/219 R |
| 3,300,179 | 1/1967 | Gooderum . | |
| 3,395,891 | 8/1968 | Burge et al. | 416/220 R |
| 3,936,222 | 2/1976 | Asplund et al. . | |
| 4,505,640 | 3/1985 | Hsing et al. . | |
| 4,778,342 | 10/1988 | Conlow | 416/220 R |
| 5,727,927 | 3/1998 | Luxenburger . | |

FOREIGN PATENT DOCUMENTS

| | | | |
|---|---|---|---|
| 335573 | 2/1959 | Germany | 403/337 |
| 745073 | 2/1956 | United Kingdom . | |
| 2111130 | 6/1983 | United Kingdom | 416/193 A |

*Primary Examiner*—Christopher Verdier
*Attorney, Agent, or Firm*—Jeffrey W. Astle

[57] ABSTRACT

A cover plate for a bladed rotor in a turbine section of a gas turbine engine which comprises an annular plate segment comprising a plurality of spaced-apart seats with each seat coincident with a rivet. The rivets are the rivets used for anchoring the root of the blade in the disc, and the seats and the covers have frusto-conical surfaces having an axis which is the axis of the rivet.

9 Claims, 3 Drawing Sheets

COVER PLATE FOR GAS TURBINE ROTOR

BACKGROUND OF THE INVENTION

1. Field of the Invention

The present invention relates to gas turbine engines, and more particularly, to turbine rotors and an improved cover plate for sealing the connection between an airfoil blade and the disc of a turbine rotor.

2. Description of the Prior Art

Turbine rotors are normally constructed with a plurality of individual airfoil rotor blades mounted to the periphery of a rotor disc. Each airfoil blade includes a root that slides into an individual slot formed in the periphery of the disc. Cover plates are required to seal the connection and the area between the root and the blade platform that is at the inner boundary of the gas flow path. Such cover plates are relatively heavy and may affect the balance of the rotor. For instance, rivets or other fasteners are necessary for mounting the cover plates.

U.S. Pat. No. 4,343,594, issued on Aug. 10, 1982 to Perry, is an example of the prior art. This patent is concerned with the weight of the covers used to seal the area between the blade platform and the disc and proposes to connect the covers by using rivets passing through the disc between the roots. In fact, the rivets are an added weight necessitated by the covers.

SUMMARY OF THE INVENTION

It is an aim of the present invention to provide an annular array of covers for sealing the root area of the disc without the necessity of additional fasteners, thereby maintaining the weight added by the covers to a minimum.

It is a further aim of the present invention to provide an array of cover plates that utilizes existing fasteners.

A construction in accordance with the present invention comprises a cover plate to be used with a bladed rotor, wherein the rotor includes a disc having an annular rim and a plurality of slots defined in the periphery of the rim of the disc, each slot extending at an acute angle to the axis of rotation of the rotor, the blades including an airfoil, a blade platform, and a root, wherein the root is inserted in the slot and a rivet extends in interference between the root of the blade and the slot to retain the blade attached to the disc, and an annular array of cover plates is provided radially along the rim to seal the roots and slots against the escape of pressurized gases axially of the rim, the individual cover plates being retained in place by the rivets that are utilized for retaining the roots of the blades within the slots.

More specifically, a shoulder is provided on the rim of the disc, radially outward and adjacent the cover plates in order to retain the plates radially against centrifugal force.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
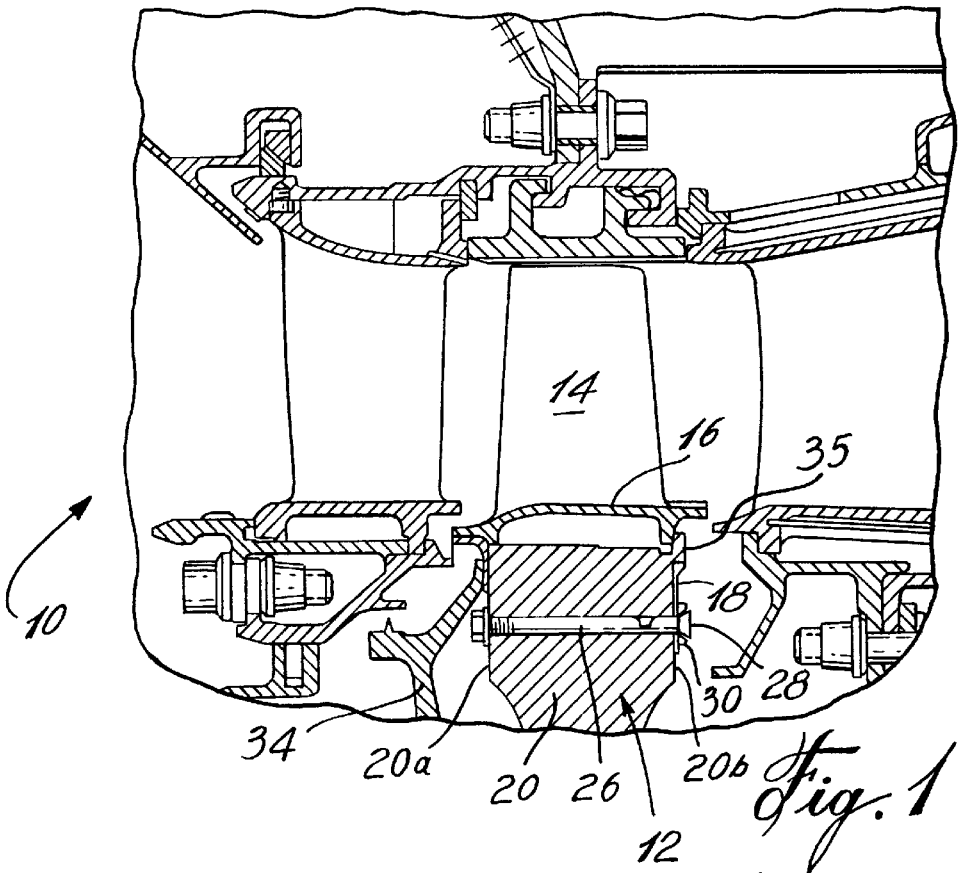
FIG. 1 is an axial cross-section taken through a typical turbine assembly of a gas turbine engine, showing an embodiment of the present invention.

Referring now to the drawings, and in particular to FIG. 1, there is shown a portion of a turbine assembly 10 for a gas turbine engine, in which a rotor 12 is shown in axial cross-section. The rotor 12 includes a disc rim 20 to which a plurality of radially extending blades 14 is mounted. Each blade 14 includes a blade platform 16. Typically, the blade 14 has a root 24 which is inserted in a slot formed in the disc rim 20, having an upstream annular surface 20*a* and a parallel downstream surface 20*b*.

A stepped shoulder 35 is formed at the radially outward edge of the downstream surface 20*b* of the disc rim 20.

A first cover 34 is located upstream of the disc rim 20 covering rim surface 20*a* and may also be utilized to direct cooling air to the blades 14. On the downstream side of the disc rim 20, a plurality of thin covers 18 is placed in an annular array on the disc rim surface 20*b* just below the platforms 16. The purpose of the covers 18 is to seal the areas between the roots 24 in the slots 36 of the rim of the rotor 12 from pressurized gases.

Each cover 18 has a plurality of seats 30 which protrude from the surface of the cover 18 and which include a flared frusto-conical surface 32, as will be described further.

A rivet 26 is normally provided, extending through the disc rim 20 from one side thereof to the other and generally at the interference between the root 24 and the material of disc rim 20. The rivet 26 helps to anchor the blade 14 in the disc rim 20 of the rotor 12.

Figure 3:
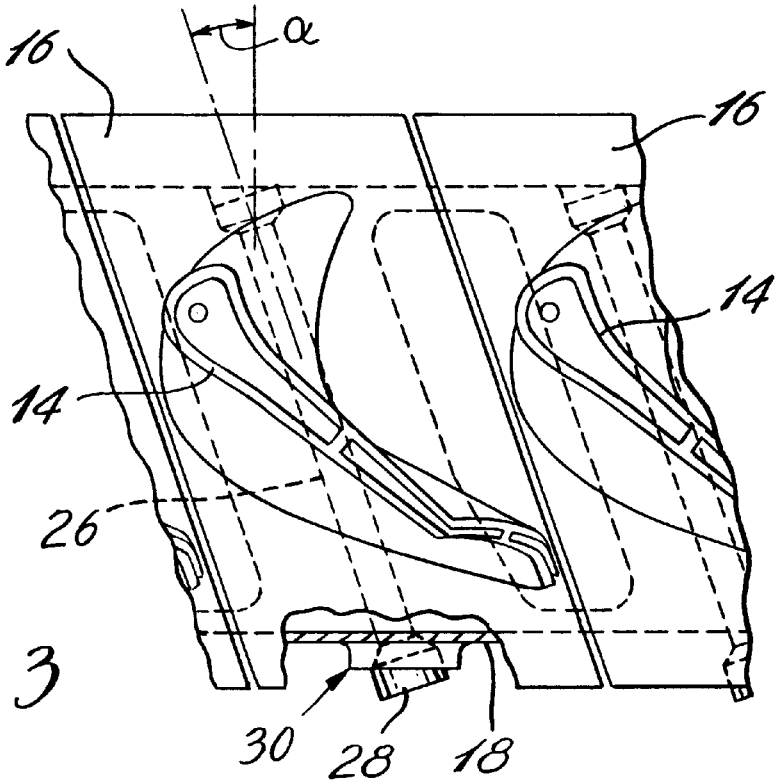
FIG. 3 is a fragmentary radial view taken from the top of the blades and partly broken away to show a feature of the present invention.
Figure 4:
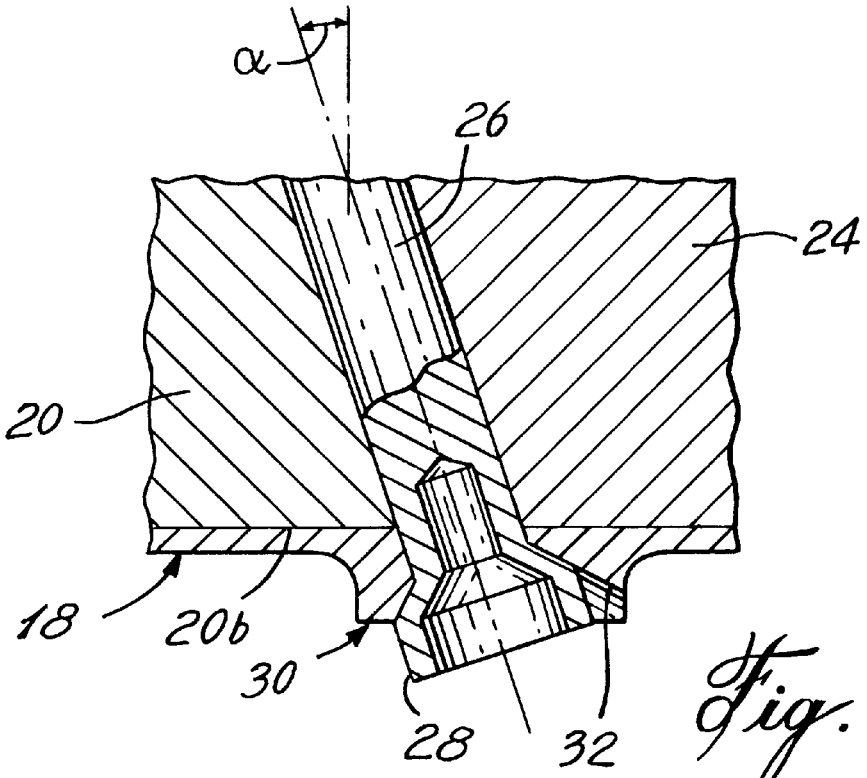
FIG. 4 is an enlarged fragmentary tangential cross-section, taken along line 4—4 of FIG. 2.
Figure 5:
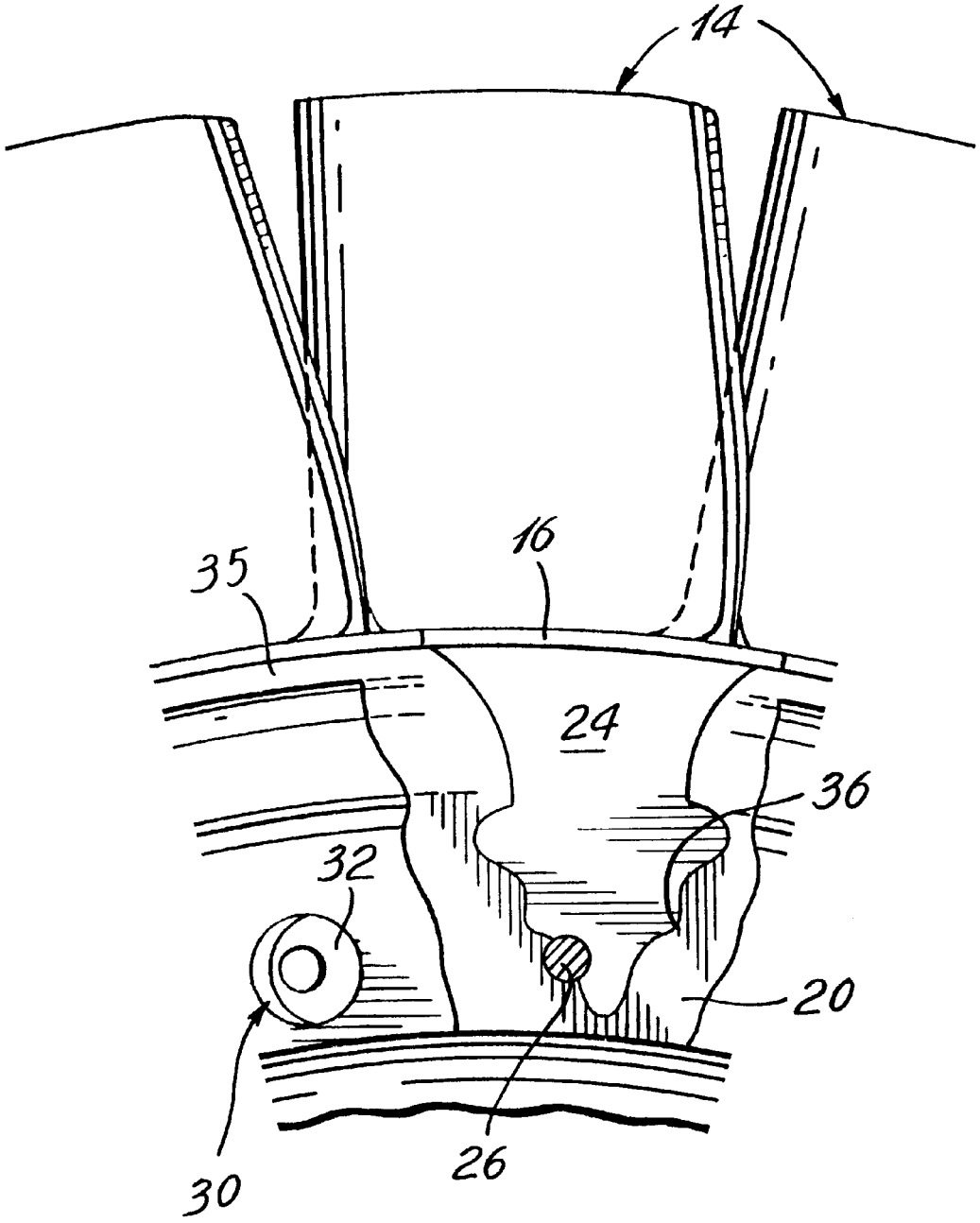
FIG. 5 is a fragmentary enlarged rear elevation, similar to FIG. 2, but with part of the cover plate cut away.

As shown in FIGS. 3 and 4, the axis of the rivet is at an acute angle $\alpha$ to the rotational axis of the rotor and generally parallel to the root of the blade 14. In a preferred embodiment, the angle $\alpha$ is 18°.

Figure 2:
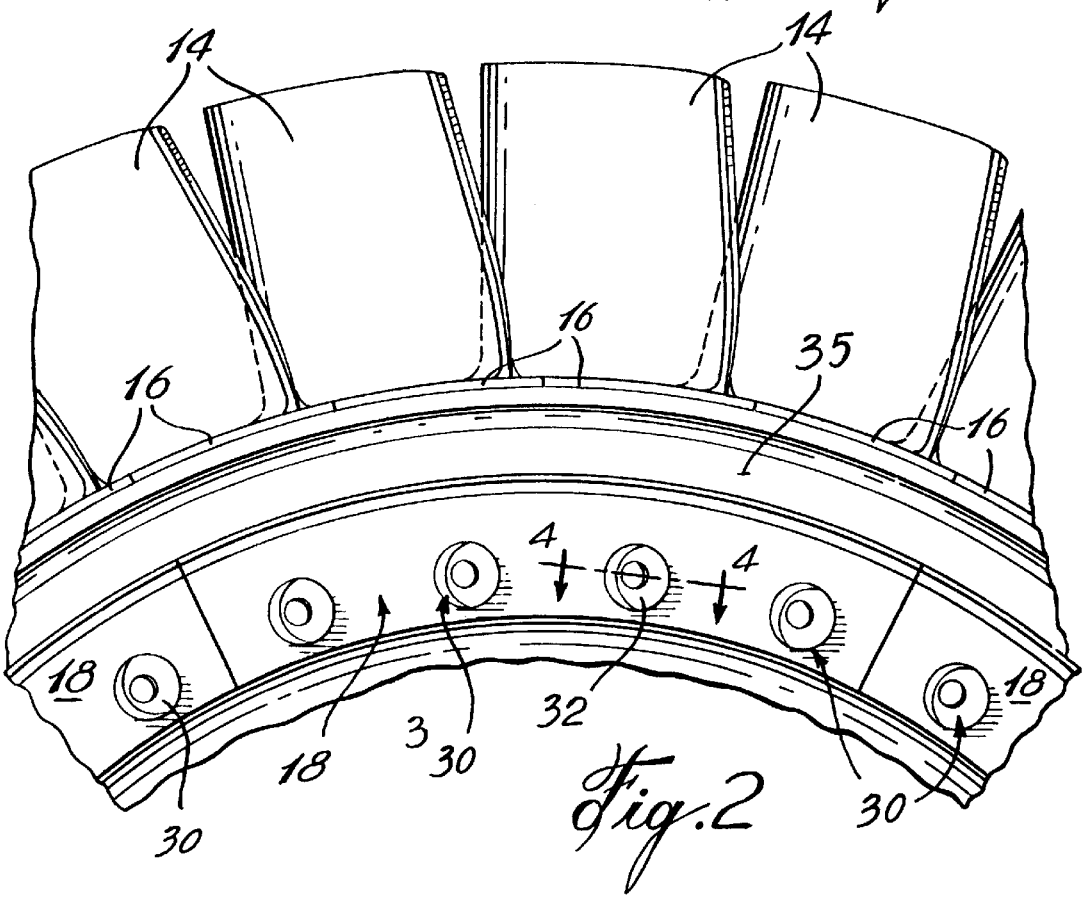
FIG. 2 is a fragmentary rear elevation showing the bladed rotor with the cover plates of the present invention.

The seats 30 of the cover plates 18 are aligned with the rivets 26. The seat 30 includes a flared, frusto-conical surface 32, the axis of which is coincident with the axis of the rivet 26, as shown in FIGS. 3 and 4. The rivet 26, normally used to anchor the root 24 of the blade 14, is accommodated by the seat 30 in the plate 18. The flared conical seat 32 accommodates the head 28 of the rivet. (The rivet heads 28 are not shown in FIG. 2.)

Thus, as can be seen, the same rivet 26 for anchoring the root can be used to fasten the cover plates 18. This contributes to keeping the weight added by providing the cover plate to a minimum, since the rivets are already a component of the rotor structure.

The cover plates 18 also abut against the shoulder 35 as seen in FIG. 1 in order to supplement the radial retention of the cover plates 18 against centrifugal forces.

The shoulder 35 has a slightly inwardly angled undercut surface in order to force the cover plates 18 closer to the rim surface 20*b* when centrifugal forces urge the cover plates 18 against the shoulder 35.

We claim:

1. In a bladed rotor for a gas turbine engine having an axis of rotation, including a disc having an annular rim and a plurality of slots defined in the periphery of the rim of the disc, each slot extending at an acute angle to the axis of rotation, each blade comprising an airfoil, a blade platform, and a root inserted in a respective slot, the bladed rotor further including a rivet extending in interference between the root and the rim at each respective slot to help retain the blade to the disc; at least one cover plate provided in a radial plane on the rim of the disc and covering the slot axially and retained in place by said rivet and cooperating with the rim, rivet, root, and slot to seal the root and slot against escape of pressurized gases axially of the rim, the improvement comprising at least one seat being set in a protrusion formed on the cover plate adapted to receive the head of the corresponding rivet and the seat having a flared conical surface with an axis which is coincident with the axis of the rivet.

2. In the bladed rotor as defined in claim 1, wherein the axis of the conical surface and the rivet are parallel to the axis of the slot and are at an acute angle to the axis of rotation of the rotor.

3. In the bladed rotor as defined in claim 2, wherein there is provided an annular array of cover plates and each cover plate of the array covers a plurality of slots.

4. In the bladed rotor as defined in claim 3, wherein each cover plate is provided with a plurality of seats, one corresponding to each slot.

5. In the bladed rotor of claim 2, wherein the acute angle is 18°.

6. A bladed rotor assembly for a gas turbine engine comprising a rotor having an axis of rotation, including a disc having an annular rim and a plurality of slots defined in the periphery of the rim of the disc, each slot extending at an acute angle to the axis of rotation, each blade comprising an airfoil, a blade platform, and a root inserted in a respective slot, a rivet extending in interference between the root and the rim at each respective slot to help retain the blade to the disc, a plurality of cover plates provided in a radial plane on the rim of the disc and covering the slots axially and retained in place by said rivets, said cover plates each having at least a seat corresponding to a respective slot, the seat being set in a protrusion on the cover plate and the seat having a flared conical surface to receive a head of a corresponding rivet with an axis which is coincident with the axis of said rivet.

7. The bladed rotor assembly as defined in claim 6, wherein there is provided an annular array of cover plates and each cover plate of the array covers a plurality of slots.

8. The bladed rotor as defined in claim 6, wherein the rim includes a shoulder at a radially remote portion of the rim, wherein the shoulder has an axial component that extends from the radial plane of the rim whereby the cover plates may be restrained by the shoulder against centrifugal forces.

9. The bladed rotor as defined in claim 8, wherein the shoulder is provided with an inwardly angled undercut surface to urge the cover plate against the radial plane of the rim when the centrifugal forces are applied to the cover plates.

* * * * *